United States Patent [19]

Mehl

[11] Patent Number: 4,682,983

[45] Date of Patent: Jul. 28, 1987

[54] TRANSFER SHEET FOR THE THERMAL DRY IMPRESSION OF CELLULOSE FIBERS

[75] Inventor: Wolfgang Mehl, Geneva, Switzerland

[73] Assignee: Sicpa Holding S.A., Glarus, Switzerland

[21] Appl. No.: 842,592

[22] Filed: Mar. 12, 1986

Related U.S. Application Data

[63] Continuation of Ser. No. 598,286, Mar. 7, 1984, abandoned.

[30] Foreign Application Priority Data

Jul. 12, 1982 [CH] Switzerland ..... 4225/82

[51] Int. Cl.[4] ..... B41M 5/02; B41M 3/12; D06P 1/16

[52] U.S. Cl. ..... 08/468; 8/467; 8/470; 8/471; 8/532; 8/650; 8/653; 8/675; 8/679; 8/918; 503/200

[58] Field of Search ..... 8/471, 470, 468

[56] References Cited

U.S. PATENT DOCUMENTS

| | | | |
|---|---|---|---|
| 4,089,648 | 5/1978 | Ohshima et al. | 8/677 |
| 4,210,412 | 7/1980 | Yamane et al. | 8/471 |
| 4,256,460 | 3/1981 | Gehrke et al. | 8/532 |
| 4,369,038 | 1/1983 | Mehl | 8/471 |

FOREIGN PATENT DOCUMENTS

| | | |
|---|---|---|
| 20292 | 12/1980 | European Pat. Off. . |
| 61428 | 9/1982 | European Pat. Off. . |
| 160767 | 11/1985 | European Pat. Off. . |
| 2808409 | 9/1978 | Fed. Rep. of Germany . |
| 50-013685 | 2/1975 | Japan . |
| 50-018782 | 2/1975 | Japan . |
| 52-046188 | 4/1977 | Japan . |
| 53-028786 | 3/1978 | Japan . |
| 56-140190 | 11/1981 | Japan . |
| 2151264 | 7/1985 | United Kingdom . |

*Primary Examiner*—A. Lionel Clingman

*Attorney, Agent, or Firm*—Sprung Horn Kramer & Woods

[57] ABSTRACT

The transfer sheet is used for dry thermal printing of water swellable celluluse fibers with dyestuffs which are insoluble in water of 60° C. The dyestuffs are difficult to evaporate and cannot be used in a conventional heat transfer printing process. They are transferred at 230° C. and a contact pressure of $10^4$–$10^6$ Pa from a base paper provided with a release coating, to cellulose fibers which have been swollen with water and the swollen state of which has been preserved after drying with a polyglycol. I order to increase the penetration of dyestuffs into the textile structure, it is recommended to lower the air pressure in the transfer area down to a pressure ranging from 1 to $5\times10^4$ Pa.

13 Claims, No Drawings

TRANSFER SHEET FOR THE THERMAL DRY IMPRESSION OF CELLULOSE FIBERS

This is a continuation, of application Ser. No. 598,286, filed Mar. 7, 1984, now abandoned.

This invention is related to new transfer sheets, especially such of paper, for the use in the heat transfer printing of water-swellable cellulosic fibers and yarns or of textile materials containing such fibers, optionally in mixture with synthetic fibers, particularly on polyester basis, with disperse dyestuffs and using polyglycols and/or polyglycol derivatives.

In the method of the conventional heat transfer printing whose principles are disclosed for example in French Pat. No. 1,233,330 and 1,585,119, transfer sheets are used which are generally of paper and which bear the pattern or design to be transferred, comprising one or more dyestuffs. In contact with a textile material, the pattern or design is transferred at 160° to 210° C. from the transfer sheet to the textile material. The dyestuffs conventionally used for heat transfer printing belong to the class of disperse dyes which are known to have only a weak affinity to natural fibers, and for this reason, the heat transfer printing has introduced itself substantially only for synthetic fibers; expecially for woven or knitted fabrics.

The attempts which have been made to render native fibers, especially cellulosic fibers, accessible to heat transfer printing, may summarily be divided into three groups: resin pretreatment of the textile; chemical modification of the fibers; and treatment of the fiber with a solvent for disperse dyes.

The resin pretreatment method is for example known from Swiss patent specification No. 564,637 which teaches the impregnation of a cotton web with a methylolether-melamine resin. After intermediate drying, the preimpregnated material is heat transfer printed. The melamine resin is condensation cured during the printing step.

The principal disadvantages of this method are due to the difficulty of obtaining a uniformity of the melamine resin coating on the textile web which influences colour depth, and to control the pretreatment in such a manner as to obtain perfect resin condensation. For these reasons, neither the uniformity of the printing nor its fastneses always fulfill the expectations, and the method has not been introduced in practice.

It is known from Swiss patent specification No. 560,286 that cellulosic fibers can be given an affinity for disperse dyestuffs by chemical modification, particularly by acetylation, benzoylation, cyanoethylation, cyanuration and grafting of styrene. Although color depth and textile handle of the chemically modified cotton are satisfactory, the method was not really successful since the process is expensive and complicated, and the wash fastness of the prints is unsatisfactory (see e.g., Eisele and Fiebig, Melliand Textilb. 61 (1980), 956–961).

It has been known for a long time that cotton and other cellulosic fibers swell in contact with water, and that the material, as a result of that swelling, becomes more voluminous and bulky and more flexible (see. e.g., Valko and Limdi, Text. Res. J. 32 (1962) 331–337). The open structure of the swollen cellulosic materials is easily penetrated by water soluble, high boiling compounds. Compounds of this nature are known which maintain the swollen state even after removal of the water. Examples of such compounds which conserve the swollen state are polyglycols and polygocl derivatives such as those disclosed in German Patent Specification No. 1,811,796 and German Patent Publication ("Offenlegungsschrift") No. 2,524,243. Polyglycols and polyglycol derivatives are generally good solvents for disperse dyestuffs. If, for example, a woven cotton fabric is impregnated with a 10 to 20 percent aqueous solution of polyethylene glycol 600, dried at 120° C. and then heat transfer printed at 200° C. to 210° C., brilliant printings of deep shades are obtained. The good dyestuff reception may be explained by the fact that hot polyglycol which remains within the fibers during the heat transfer printing step, dissolves the dyestuff vapors and finely distributes the dissolved dyestuff within the fibers.

The prints thus obtained with the conventional heat transfer printing dyestuffs have, however, very bad wash fastnesses so that this method could not be used extensively.

The problem of wash fastnesses can in principle be resolved if disperse dyes or vat dyes are used which are insoluble in water even at elevated temperatures such as 60° C.

One way of finding such dyestuffs consists of preparing a saturated solution of the dyestuff to be tested, in boiling aqueous 0.1 molar sodium carbonate solution, and measuring its optical absorbance with a commercial spectrometer. Only such disperse or vat dyes are taken into account whose absorbance is not higher than 0.3. Such dyestuffs are known from German Patent Specification No. 1,811,796 and from German Patent Application No. 25 24 243. The dyestuffs have primarily a molecular weight of more than 350 and a high sublimation fastness since they are difficult to vaporize.

Even in the temperature range of from 225° to 235° C. which is a range extraordinarily high for sublimation transfer printing, the evaporation rate of these dyestuffs is generally so low that no transfer printing can be achieved.

The use of vacuum calenders, known from my Swiss Patent Application no. 2316/79, which allows raising the mean free path of the dyestuff vapour molecules in an air pressure reduced to 0.5 to $1\times10^4$ Pa, has also been found in practice not to be successful since the evaporation rate stil remains very low so that the dyestuffs are transferred form the transfer sheet to the substrate only with low yield and the prints thus obtained lack in colour depth. The penetration of the textile fabric remains insufficient, and the rub fastnesses are bad, obviously due to the formation of large dyestuff aggregates on the surface of the textile material.

These disadvantages of the known art are now eliminated by the new transfer sheets of the present invention.

The transfer sheets of the invention are characterized by the fact that they are coated with a release layer on a flexible, heat resistant support, for example a paper web, and that the release layer has been provided with a uniformly colored layer or a design of a mixture comprising a binder and one or more dyestuffs. The design can be applied by any suitable printing method, such as gravure printing, screen printing, offset printing etc. The design or pattern comprising binder and dyestuff which may be present as a colour shades, is transferred as a whole by the application of pressure and temperature on the textile substrate. The release coating eases the transfer of the design from the transfer sheet to the textile web by reducing the force of adherence of the design to its support. Release coatings are well known to the main skilled in the art; they comprise for example a silicone resin layer or a layer of another resin having low adherence properties. The printing of surfaces comprising a release layer, with aqueous printing inks may raise problems due to the bad wettability; preferably printing inks comprising a non-aqueous solvent are thus used for this reason.

The binder comprises one or more high molecular organic substances, at least one of them being a film-forming material. The high molecular organic substances are characterized by the fact that their softening point or melting point, respectively, is comprised between at least 50° and at most 150° C., preferably at most 100° C. The high molecular organic substances belong for example to the class of resins and waxes. Examples are natural resins, maleinate resins, phenolic resins, urea resins, resins from unsaturated hydrocarbons, epoxy resins, polyamide resins, polyglycols having a molecular weight of at least 1000, polyolefin resins, natural waxes, Fischer-Tropsch waxes, amide waxes, fatty acid esters, fatty alcohols. (See e.g. E. Karsten "Lackrohstoff-Tabellen", published by C. R. Vincentz, Hanover, Germany, 1976.)

Preferably, maleinate resins and resins based upon colophonium are used, for example esters of polyvalent alcohols such as the esters of glycerol and pentaerythritol.

The dyestuffs are characterized by the fact that they belong to the group of disperse and vat dyes, and that they are insoluble in water of 60° C. They belong for example to the following dyestuff types:

Anthraquinone dyes, azo dyes, indigo dyes and thioindigo dyes. The following dyestuff series have been found to be particularly advantageous:

(1) Halogenated, preferably chlorinated or brominated diphenylamino anthraquinones;
(2) Alkylimides of the 1,4-diamino-anthraquinone-2,3-dicarboxylic acid wherein the alkyl group bears one or two phenyl residues,
(3) 1-Benzoylamino anthraquinones bearing in the 4, 5 or 8 position a residue phenyl-NH-;
(4) Phenylamides of 1-phenylazo-2-hydroxy-3-naphtoic acid, preferably those which are free from nitrogen containing substitutents; and
(5) Phenyl or naphtyl amides of phenylazo acetylacetic acid or phenylazo benzoylacetic acids, particularly those which are free from nitrogen containing substituents.

In all these dyestuffs, the phenyl and benzoyl moieties may carry simple substituents such as methyl, ethyl, chloro, bromo, methoxy and trifluoromethyl groups, even butyl or isoamyl groups; preferably, they do however not comprise nitrogen containing substituents.

Further characteristic examples are the following: 1-amino-2-methoxy-4-toluenesulfonylamino anthraquinone, 1,4- and 1,5-dibutyrylamino anthraquinone and the corresponding derivatives of the methoxybenzoic acid and trifluoromethylbenzoic acid; benzoylamino isothiazolanthrone, the diphenylamides of the 1-phenylazo-2-hydroxy-3-naphtoic acid bearing on one or the other or on both phenyl groups one or more substituents selected from the group comprising halogen atoms, particularly fluorine, chlorine, bromine; methyl, ethyl, isopropyl, methoxy, ethoxy, trifluoromethyl and acetyl groups; 1-benzoylamino-4-anilino-anthraquinone, 1-phenylbenzoylamino anthraquinone, 1-phenylazo-benzoylamino anthraquinone, 1-phenylbenzoylamino-4-methoxy anthraquinone, 1-benzoylamino-4-(p-isopropyl or -isoamylanilino)anthraquinone; monoazo dyes obtained by coupling of the naphtanilide of acetyl or benzoyl acetic acid on diazotated nitroaniline or nitrotoluidine; the coupling product of barbituric acid on diazotated nitroanisidine; the dyestuffs obtained by coupling of the diazo compound of nitrophenyl aniline on the napthanilide of acetyl or benzoyl acetic acid; and dioxazines which are obtained by the cyclisation of the condensation products of chloranil (tetrachloro-p-benzoquinone) with naphthylamine, aminopyrene, aniline and its derivates like p-chloroaniline, toluidine, anisidine, cresidine, p-isopropylaniline, m-trifluoromethylaniline, and p-dimethylaminoaniline.

In order to select the dyestuff, it is necessary to prepare from them a printing ink. Such printing inks may be of the offset type, or water or solvent based printing inks. The techniques for the preparation of such printing inks are known per se.

For example, the dyestuff in form of a 100% pure dry press cake, may be milled with a ball mill, e.g. a "dynomill" type (Bachofen, Basel, Switzerland) in industrial grade ethanol, containing a binder of the type known from conventional heat transfer printing, e.g. ethyl cellulose N-7 (Dow Chemical Co.).

The preferred concentrations are 5 to 10% of binder and not more than 10% of dyestuff. The milling is continued until 90% of the dyestuff particles have a diameter of less than three micrometers, no particle being larger than five micrometers. The printing inks obtained in this fashion are applied by gravure printing on a paper support as known from conventional heat transfer printing. These printing sheet may then be used to make heat transfer printing tests on a swollen cotton fabric.

The cotton fabric was swollen according to the teachings of German Patent Specification No. 1,811,796. This patent teaches that the swollen state of cotton, provoked by treatment with water, can be maintained after drying by a polyglycol, e.g. polyethylene glycol having a molecular weight in the range of 300 to 1100, the amount of said glycol being for example 10 to 20% of the cotton weight.

For dyestuff selection, the transfer sheet is applied during 30 seconds with a pressure of $5\times10^4$ Pa at a temperature of 235° C. against the swollen cotton fabric, this "sandwich" being kept under an air pressure reduced to $10^4$ Pa.

Those dyestuffs are selected which are transferred, under these transfer printing conditions, with an amount of at least 60% from the transfer sheet to the textile substrate. typical examples of dyestuffs which were selected in this matter are:

Yellow dyestuffs:
C.I. Disperse Yellow 213,
C.I. Disperse Yellow 214,
C.I. Disperse Yellow 136, Red dyestuffs:
C.I. Disperse Red 346,
C.I. Disperse Red 271,
C.I. Disperse Red 220, Blue dyestuffs;
C.I. Disperse Blue 192,
C.I. Disperse Blue 238,
C.I. Disperse Blue 327,
C.I. Disperse Blue 328, and furthermore C.I. Disperse Orange 125, C.I. Disperse Green 7, C.I. Disperse Violet 64, C.I. Disperse Violet 89 and C.I. Disperse Brown 21.

For the preparation of the new transfer sheets of the invention by means of these dyestuffs, a printing ink is prepared which typically contains 10% of dyestuff, 10 % of binder and 80% of solvent. This printing ink is used to print a base paper which has been provided with a release coating, with a design containing one or more dyestuff.

The new transfer sheet of the invention are then used to print dry, swollen cotton at 235° C. under a contact pressure of at least $10^4$ Pa during 20 to 60 seconds.

Brilliant impressions are obtained which distinquish themselves by high wash fastnesses and generally high light fastnesses. The "hand" is remarkably good, and the rub fastnesses are very good after the first washing.

The new transfer sheets are characterized by the possibility of the use of dyestuffs which do not sublimate at all in the conventional heat transfer printing, due to high sublimation fastness, and which can be transferred under the conditions of the heat transfer printing under reduced air pressure, i.e. with sophisticated machinery only and with unsufficient yields. It is now possible to make use of the versatility of the transfer printing process in the printing of natural fibers in safeguarding their textile mechanical properties and in respecting the necesary fastnesses, particularly the washing fastnesses.

EXAMPLE 1

A screen printing ink is prepared by dissolving of 40 parts of the phtalate resin "ERKAPEX 1560" (R. Kraemer GmbH) and 5 parts of Polywax 6000 in 90 parts of ethanol. To 150 parts of this solution, 50 parts of a 20 percent alcoholic dispersion of the dyestuff C.I. Disperse Red 346 are added.

A release paper is printed in a conventional flat stencil screen printing machine with this printing ink. The release paper had been obtained by coating a base paper of 60 g/m$^2$ with polyvinyl alcohol type "Polyviol W25/140" (Wacker-Chemie).

To prepare the heat transfer printing, a cotton fabric is impregnated in a pad mangle at 100% pick-up with a solution 10% of polypropylene glycol 425 in water and then dried on the tenter frame at 120° C. For transfer printing, the paper is maintained applied during 45 sec. in a heat transfer press of Kannegiesser (Vlotho, GFR) under a contact pressure of $5\times10^4$ Pa at 235° C. (press hot plate temperature) against the pretreated cotton fabric.

A brilliant red printing with good wash light and sweat fastnesses is obtained. The rub fastnesses are acceptable. They become good on rinsing the fabric in cold water, and very good (note 4–5 dry and wet) after washing at 60° C.

EXAMPLE 2

For the production of an offset printing ink, a varnish is first prepared on a three cylinder roller mill by mixing of 42 parts of lacquer linseed oil and 38 parts of a phenol resin type "Albertol KP 351" (Hoechst AG).

The printing ink is prepared on a three cylinder roller mill from 20 parts of the dyestuff C.I. Disperse Blue 327, 85 parts of the varnish, 5 parts of Aerosil R972 (DEGUSSA AG) and 2 parts of cobalt siccative.

A release paper is prepared by coating of 60 g/m$^2$ base paper with a solution made from 67 parts of ethyl alcohol, 3 parts of toluene, 25 parts of the polyamide resin "Eurelon 2300" (Schering AG) and 5 parts of the melamine resin "Cibamin M-100" (Ciba-Geigy AG).

This release paper is printed on a conventional offset printing press of the company "Heidelberg Offset". For preparing the heat transfer printing, a woven fabric, 50% cotton and 50% polyester, is treated in a pad mangle with a 10% aqueous solution of polypropylene glycol 425 and squeezed to a pick-up of 80%, then dried during one minute at 120 C. on a tenter frame.

The offset printed release transfer paper is then heat transfer printed during 45 sec. with a contact pressure of $5\times10^4$ Pa at 230° C. on the mixed fiber fabric.

A brilliant blue print is obtained. The "hand" of the fabric and the fastnesses are acceptable already just after the transfer printing; after rinsing with cold water, they become excellent.

EXAMPLE 3

The part of a cotton fabric which is to be printed, is pretreated by spraying a 2% aqueous solution of polyethylene glycol 600 on the fabric which is then dried during 30 sec. at 190° C. For heat transfer printing, a transfer sheet prepared in Example 2 is contacted with the pretreated zone of the cotton fabric during 45 sec. at 230° C., a contact pressure of $5\times10^4$ Pa, and at an air pressure of $2\times10^4$ Pa.

A brilliant blue impression with excellent penetration is obtained.

EXAMPLE 4

A stock thickening for a gravure printing ink is prepared by dissolving 12.5 parts of a glycerol resin ester, type "Halwepal-G" (Chemische Werke Hüttenes-Albertus) in a mixture of 40 parts of ethyl alcohol and 40 parts of methyl ethyl ketone. This stock thickening is divided into three equal parts.

To the first part of this solution, 92.5 parts, are given 7.5 parts of the dyestuff C.I. Disperse Red 346, and the mixture is milled in a ball mill of the type "Dynomill" (Bachofen AG). The milling is continued until 90% of the dyestuff particles are smaller than 3 micrometers, and the coarsest particles are smaller than 5 micrometers.

In the second part of the solution, 8% of the dyestuff C.I. Disperse Yellow 213 are dispersed in the same manner, and in the third part of the stock thickening, 9.5% of the dyestuff C.I. Disperse Blue 327 are dispsered.

Three gravure printing inks are thus obtained in the colour shades red, yellow and blue.

In a conventional gravure printing machine, the basic release paper described in Example 1 is printed with three printing cylinders. After each cylinder, an intermediate drying is necessary.

The cylinders are engraved in such a manner that the superimposition of the three prints gives the image conformable reproduction of a base design according to the trichrome principle.

In order to prepare the heat transfer printing, a woven fabric of mercerized cotton is impregnated on the pad mangle with a ten percent aqueous solution of a polyglycol boric acid ester, commercially available under the name "Glyecin-CD" (BASF), pick-up 100% by weight, and then dried on the tenter frame at 120° C. On the material so pretreated, the helio release transfer paper is heat transfer printed during 40 seconds at 230° C. and a contact pressure of $10^5$ Pa.

A brilliant multicolour printing with good light and wet fastnesses is obtained.

I claim:

1. A transfer sheet for the heat transfer printing of textile materials which contain cellulosic fibers pretreated for swelling, said sheets consisting essentially of an inert, flexible substrate having a release coating on a least one-surface thereof, said release coating carrying a dyestuff-containing coating or design, wherein the dyestuff-containing coating or design is a mixture containing (a) a binder containing at least one high molecular, organic, film forming substance having a softening point between 50° and 150° C., said binder selected from the group consisting of naturally occuring resins, maleinate resins, phenolic resins, urea resins, polymerized unsaturated hydrocarbons, epoxy resins, polymide resins and rosin modified resins, and (b) at least one disperse or vat dyestuff, said dyestuff does not sublimate in conventional heat transfer printing, said dyestuff having an optical absorptivity not exceeding 0.3 when in a boiling, saturated solution in 0.1 molar aqueous sodium carbonate and (i) that the dyestuff is transferred from a transfer paper normally used in heat transfer printing, at a rate of not more than 40% by weight when said transfer sheet is pressed against the textile material under a contact pressure of 5 kPa and maintained under atmospheric air pressure for 30 seconds at 200° C., the textile material being swollen with water and whose swollen state has been preserved after drying by a polyglycol or a polyglycol derivative, and (ii) that the dyestuff is transferred at a rate of more than 60% by weight when said transfer sheet is pressed against the textile material under a contact pressure of 50 kPa, and at an atmospheric air pressure of 10 kPa, for 30 seconds at 230° C.

2. A transfer sheet according to claim 1, wherein the binder further contains at least one wax selected from the group consisting of polyglycols having a molecular weight of at least 1000, polyolefin waxes, natural waxes, Fischer-Tropsch waxes, amide waxes, fatty acid esters and fatty alcohols.

3. A transfer sheet according to claim 1, wherein the dyestuff is selected from the group consisting of azo dyestuffs, anthraquinone dyestuffs, indigo dyestuffs and thioindigo dyestuffs, said dyestuffs having a molecular weight in the range of 350 to 600.

4. A transfer sheet according to claim 1, wherein said dyestuff comprises a dyestuff of the general formula

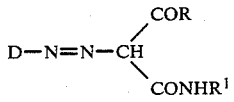

wherein:

D represents a radical of a diazo component of the aniline, aminoazobenzene, aminophtalimide, anthraquinone or benzanthrone series, R represents $C_1$ to $C_4$ alkyl or phenyl which is unsubstituted or substituted by chloro, bromo, methyl, methoxy or ethoxy, and $R^1$ represents phenyl, unsubstituted or substituted by chloro, bromo, methyl, ethyl, methoxy, ethoxy, benzyloxy, phenoxy, chlorophenoxy, optionally N-substituted carbamoyl, sulfamoyl or phtalimidyl, $C_1$ to $C_8$ alcoxycarbonyl, cyano or phenylsulfonyl.

5. A transfer sheet according to claim 1, wherein the dyestuff comprises a phenloxyacetamino, phenyl—O-CO—O—, phenyl—OCO—NH— or benzoylamino group, such group being bonded to a monoanthraquinone nucleus, said phenyl or benzoyl moities optionally carrying one or more substituents selected from the group consisting of methyl, ethyl, methoxy, ethoxy, trifluoromethyl, fluoro, chloro and bromo.

6. A transfer sheet according to claim 1, wherein the dyestuff is at least one of the following dyestuffs:

(a) halogenated dianilino anthraquinones;

(b) N-alkylimides of the 1,4-diaminoanthraquinone-2,3-dicarboxylic acid, said alkyl group being substituted by one or two benzene radicals;

(c) arylides of the 1-phenylazo-2-hydroxy-3-naphthoic acid;

(d) naphthyl amides of α-phenylazo-acetylacetic acids and phenyl amides of α-phenylazo-benzoylacetic acids; or (e) 1-benzoylamino-anthraquinones substituted in the 4, 5 or 8 position by phenyl—NH—, said phenyl or benzoyl moieties being unsubstituted or substituted by methyl, ethyl, ethoxy, ethoxy, trifluoromethyl, fluoro, chloro or bromo.

7. A transfer sheet according to claim 1, wherein one of said dyestuffs is 1-benzoylamino-4- or -5-anilino anthraquinone, wherein at least one of the benzoyl and anilino moieties is at least once substituted by fluoro, chloro, lower alkyl, lower alkoxy, trifluoromethyl or bromo.

8. A transfer sheet according to claim 1, wherein said dyestuff is a dyestuff selected from the group consisting of C.I. Disperse Yellow 214,
C.I. Disperse Yellow 213,
C.I. Disperse Red 346,
C.I. Disperse Blue 327,
C.I. Disperse Blue 328,
C.I. Disperse Brown 21 and
C.I. Disperse Violet 89.

9. A process for the heat transfer printing of textile material of cellulosic fibers or of mixtures thereof with synthetic fibers, comprising swelling the cellulosic fibers with water and preserving their swollen state on drying by a polyglycol or a polyglycol derivative, the textile material then being contacted with a transfer sheet at elevated temperatures, wherein a transfer sheet of claim 15, is used, which shet is held in contact with the textile material during 30 to 60 seconds at 200° to 230° at a contact pressure of from 10 kPa to 1 MPa.

10. A process of claim 9, wherein the transfer printing is operated at an air pressure of from 10 to 50 kPa.

11. A process of claim 9, wherein the polyglycol or its derivative as well as a transferred binder are removed from the textile material after the transfer.

12. A process of claim 9, wherein the textile material is sprayed on part or the whole of its surface, prior to the transfer printing, with an aqueous solution of less than 0.5% of a polyglycol or a polyglycol derivative, and then dried.

13. A process according to claim 9, wherein the removal is conducted by rinsing with water or a solvent.

* * * * *

UNITED STATES PATENT AND TRADEMARK OFFICE

CERTIFICATE OF CORRECTION

PATENT NO. : 4,682,983

DATED : July 28, 1987

INVENTOR(S) : Wolfgang Mehl

It is certified that error appears in the above-identified patent and that said Letters Patent is hereby corrected as shown below:

| | |
|---|---|
| Title Page, under "Abstract", line 4 from bottom | Delete "I" and substitute --In-- |
| Col. 1, line 47 | Delete "neses" and substitute --nesses-- |
| Col. 2, line 2 | Delete "polygocl" and substitute --polyglycol-- |
| Col. 2,line 46 | Delete "stil" and substitute --still-- |
| Col. 3, line 3 | Delete "main" and substitute --man-- |
| Col. 6, lines 48-49 | Correct spelling of --dispersed-- |
| Col. 8, line 52 | Delete "15" and substitute --1-- |
| Col. 8, line 52 | Delete "shet" and substitute --sheet-- |

Signed and Sealed this

Nineteenth Day of April, 1988

*Attest:*

*Attesting Officer*

DONALD J. QUIGG

*Commissioner of Patents and Trademarks*